United States Patent [19]

Six

[11] Patent Number: 5,018,445

[45] Date of Patent: May 28, 1991

[54] MAGNETICALLY DELIVERED INK

[76] Inventor: Albert J. Six, 22425 Santa Paula Ave., Cupertino, Calif. 95014

[21] Appl. No.: 183,660

[22] Filed: Apr. 19, 1988

[51] Int. Cl.[5] ..... B41M 5/00

[52] U.S. Cl. ..... 101/489; 101/491; 101/350; 427/128; 346/74.2

[58] Field of Search ..... 104/DIG. 13, 344, 348, 104/350; 101/489, 491, 494; 346/74.2; 427/128

[56] References Cited

U.S. PATENT DOCUMENTS

| | | | |
|---|---|---|---|
| 3,477,368 | 11/1969 | Spaulding | 101/491 |
| 3,509,816 | 5/1970 | Spaulding | 101/491 |
| 3,624,731 | 11/1971 | Lindberg | 101/489 X |
| 3,952,119 | 4/1976 | Bubler | 101/491 X |
| 4,051,484 | 9/1977 | Martin | 101/489 X |
| 4,276,829 | 7/1981 | Chen | 101/489 |
| 4,282,303 | 8/1981 | Bergen | 101/489 X |
| 4,296,176 | 10/1981 | Lennon et al. | 101/491 X |
| 4,527,169 | 7/1985 | Springer | 346/74.2 |
| 4,537,127 | 8/1985 | Jadner et al. | 101/348 X |
| 4,566,938 | 1/1986 | Jenkins et al. | 101/348 X |
| 4,691,432 | 9/1987 | Haren et al. | 101/348 X |
| 4,722,274 | 2/1988 | Jeschke et al. | 101/349 X |
| 4,724,764 | 2/1988 | MacPhee et al. | 101/349 X |
| 4,734,708 | 3/1988 | Saitoh et al. | 346/74.2 |

OTHER PUBLICATIONS

Xerox Disclosure Journal vol. 10, No. 3 May/Jun. 1985.

*Primary Examiner*—Edgar S. Burr
*Assistant Examiner*—Ren Yan
*Attorney, Agent, or Firm*—Fliesler, Dubb, Meyer & Lovejoy

[57] ABSTRACT

A printing composition comprising magnetic particles suspended in a liquid medium also having therein a coloring agent, the relative amounts of the particles and the coloring agent being controlled whereby the color of the composition is principally that of the coloring agent. The composition can be contacted with selectively magnetized portions of the surface of a drum to provide an image thereon and the drum surface contacted with a sheet which abstracts the printing composition. The composition is useful in an apparatus which includes such a drum, equipment for magnetizing, a set up for contacting the cylindrical surface with the printing composition and a mechanism for contacting the cylindrical surface with the abstracting sheet. Magnetographic color printing results.

12 Claims, 1 Drawing Sheet

FIGURE 1
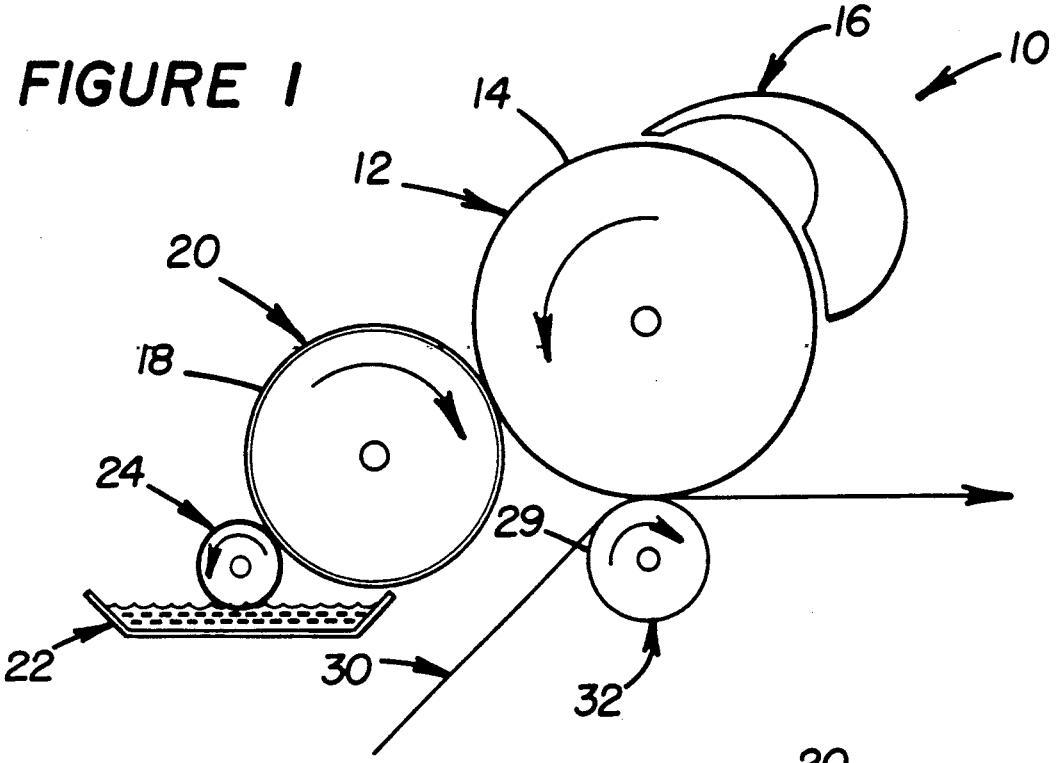
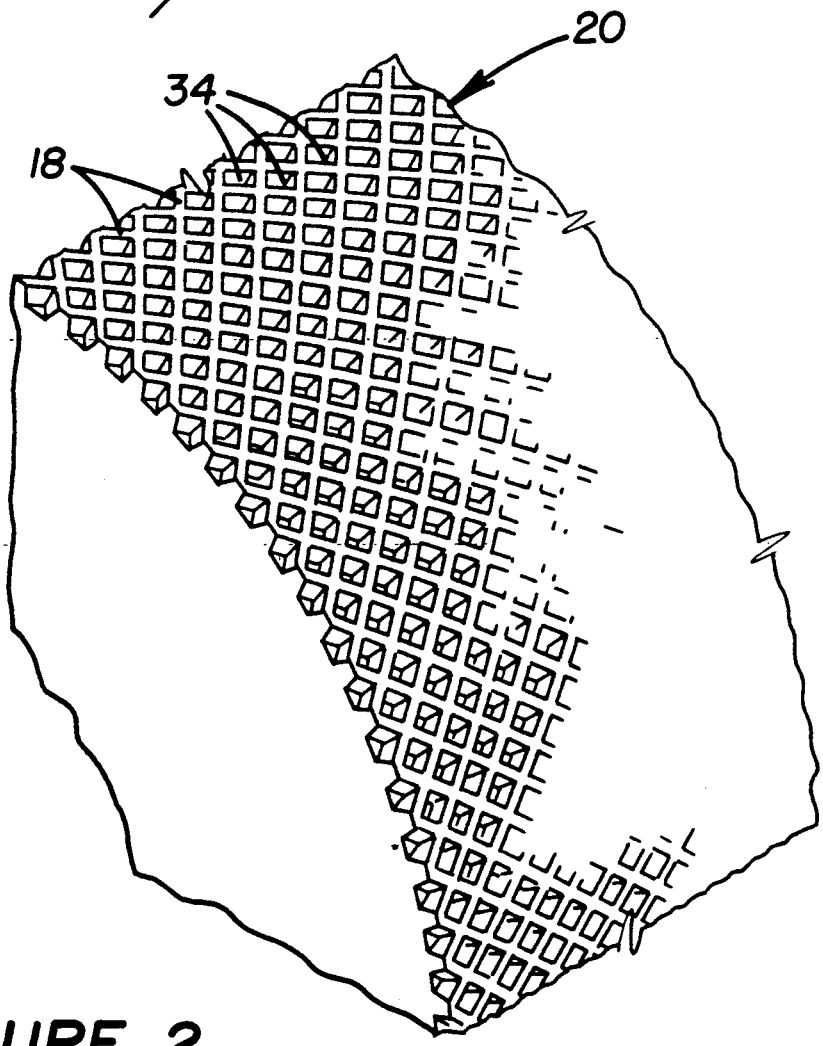
FIGURE 2

MAGNETICALLY DELIVERED INK

FIELD OF THE INVENTION

The present invention relates to a novel printing composition, a method of printing using such a composition and a printing apparatus using such a composition. More particularly, the invention relates to the printing composition useful with a printing apparatus which utilizes a magnetic drum.

BACKGROUND OF THE INVENTION

Magnetographic printing is a relatively recent but well known technique. The magnetographic printing process operates by transferring an image which is be printed onto a magnetic drum with the image being represented on the cylindrical surface of the drum by magnetized portions or areas (really small spots) on the drum surface. The magnetized portions are provided by utilizing one or more magnetic recording heads. The latent image on the drum is then toned with magnetic particles. Thereafter, the toned imaged image is transferred to a sheet of paper or other material and is then fixed to the paper. A great advantage of magnetographic printing is that it is a high speed operation capable of outputs of 600 linear feet per minute. One commercial apparatus for carrying out magnetographic printing is the Cynthia MP 6090 Page Printer (trademark) sold by Bull Peripheriques and described in detail in Cynthia MP 6090 Page Printer Product Specification, 1985, published by Bull Peripheriques Direction.

In the case of development of electrostatic images an electric field may be used to cause ink, for example, on an analog roller to extend and deposit on a drum. Such is discussed, for example, in U.S. Pat. Nos. 4,202,620; 4,202,913 and 4,268,597 of I.L. Klavan, et al. In a magnetographic printing process wherein particles are attracted to selectively magnetized (not electrically charged) portions of a drum, such a technique is not applicable and has not been used. Indeed, limitation on magnetographic printing has been the fact that the toner is in the nature of powdered magnetic iron oxide. This material is quite satisfactory for printing in black, but is highly unsatisfactory for printing in any other color. Thus, high speed quality color printing has not been possible using this technique. Attempts have been made to coat the iron oxide with a white coating and then with a coating of desired color to allow the production of multicolored images, or at least images in other colors besides black. Such attempts have had, at best, limited success since the magnetic iron oxide particles are quite black whereby providing a white coating followed by a coating of a desired color will generally not completely block out the blackness of the iron oxide. As a result the color has a significant grayish or blackish tinge and is far from bright. If sufficient white coating and then coloring is placed over an iron oxide particle so that the desired color is sufficiently bright, the coatings must be so thick that the particles cannot be reasonably used for magnetographic printing.

Color printing by typical electrostatic processes produces acceptable colored images only at a low rate of speed, perhaps about 6 linear feet per minute. It would be very desirable if it were possible to produce acceptable colored images at high magnetographic printing output rates.

The present invention is directed to overcoming one or more of the problems as set forth above.

DISCLOSURE OF INVENTION

In accordance with an embodiment of the present invention, a printing composition is set forth comprising a plurality of ferromagnetic particles in suspension in a liquid medium having dissolved or suspended therein a coloring agent, the relative amounts of the particles and of the coloring agent being controlled whereby the color of the printing composition is substantially that of the coloring agent.

In accordance with another embodiment of the present invention, a magnetographic printing method is set forth. The method comprising selectively magnetizing portions of the cylindrical surface of a drum to thereby provide an image on it. The magnetized portions of the drum are contacted with a printing composition as set forth above whereby the magnetized portions of the drum are selectively coated by the printing composition. The cylindrical surface of the drum is then contacted with a sheet which abstracts substantially all of the printing composition from the selectively coated portions on the cylindrical surface.

In accordance with still another embodiment of the present invention a magnetic printing apparatus is set forth. The apparatus comprises a drum having a cylindrical surface capable of being magnetized. Means are provided for magnetizing selected portions of the cylindrical surface. Printing composition contacting means are provided for contacting selectively magnetized portions of the cylindrical surface with a printing composition as set forth above to selectively coat the selectively magnetized portions. Means are provided for contacting the cylindrical surface of the drum with a sheet which abstracts substantially all of the printing composition from the selectively coated portions on the cylindrical surface.

Operation in accordance with the present invention allows the delivery of relatively large amounts of a coloring agent for each relatively small magnetic particle which is transferred onto the magnetic drum of a magnetographic printing apparatus. This is accomplished by having the coloring agent dissolved and/or suspended in a liquid medium or ink. Each time a magnetic particle is transferred to the drum it swells toward and carries along with it a droplet of the ink. Thus, relatively small and few magnetic particles may be utilized to transfer a relatively large and highly coloring agent loaded ink. As a result, magnetographic printing can be carried forth to provided images of different colors than black. Furthermore, the amount of, for example, iron oxide, transferred can be kept relatively low whereby the colors are not made substantially dark or gray.

BRIEF DESCRIPTION OF DRAWING

The invention will be better understood by reference to the figures of the drawing wherein like numbers denote like parts throughout and wherein:

FIG. 1 illustrates, schematically, an embodiment of an apparatus and an embodiment of a method in accordance with the present invention; and FIG. 2 illustrates, in partial view, the surface of an anilox roller useful in the practice of the present invention.

BEST MODE FOR CARRYING OUT INVENTION

The drawing illustrates schematically the use of a magnetographic printing apparatus 10 which includes a magnetic drum 12 rotable about its cylindrical axis. A cylindrical surface 14 of the drum 12 is formed of a magnetic material. A recording head 16 writes magnetically, i.e., it magnetizes selected spots, on the rotating drum 12.

As the drum 12 continues to rotate the recorded magnetic image arrives at and passes very near but not quite in contact with the surface 18 of an anilox roller 20 which is rotating about its axis in such a manner that the surface velocity of the anilox roller 20 and of the magnetic drum 12 at the point of closest approach are identical. The anilox roller 20 picks up charged ink from an ink fountain 22 via an ink transfer roller 24.

In accordance with the invention the ink extends toward, touches and adheres only to the magnetized areas on the drum 12 in a manner which will be explained below. The surface 14 of the drum 12 then contacts a surface 29 of a sheet 30, which in the embodiment illustrated is shown as a continuous sheet, and the ink is transferred from the magnetized areas of the surface 12 of the drum onto the sheet which is in that area backed by an appropriate roller 32. Thus, the transfer from the magnetic drum 12 to the sheet 30 is by means of pressure between the drum 12 and the transfer roller 32 plus having the transfer roller 32 being at an appropriate potential, for example, −800 volts to −1200 volts.

The use of the anilox roller 20 is particularly desirable in accordance with the present invention for transferring the ink onto the magnetic drum 12. The anilox roller 20 (see FIG. 2) is a roller that has a plurality of small cups or cells 34 on its cylindrical surface 18, the cells 34 being filled with ink when they contact the inking roller 24. Because of surface tension, the ink is normally held within the small cells 34 on the surface 36 of the anilox roller 20 and only leaves the cells 34 if there is a force available which will stretch the surface whereby the ink in the cells 34 extends away from the surface 36 of the anilox roller 20 far enough to contact the cylindrical surface 14 of the drum 12 and be drawn out of the cup or cell 34.

The cells 34 can be of any reasonable size and are often tapered in shape being smaller at the bottom of the cell 34 than they are at the top of the cell 34 which corresponds to the surface of the anilox roller 20. For example, the opening at the top might be on the order of 50 to 200 microns while the bottom of the cell 34 might be of the order of 5 to 75 microns across. The dimensions are not critical but should be such as to provide sufficient ink while still retaining the liquid in the cell 34 except when there is some impelling force for causing the liquid in the cell 34 to contact the cylindrical surface 14. Most cells 34 of this sort have openings at the top surface of about 80 to 115 microns and at the bottom are from about 15 to 35 microns across.

In accordance with the present invention, the impetus for propelling the ink out each of the cells 34 comes from the magnetic properties of the suspended ferromagnetic particles. As the ferromagnetic particles are drawn through the liquid and against its surface and finally from the surface onto the magnetized portions on the cylindrical surface 14 of the drum 12, the ink swells towards the drum 12, travels with the magnetic particles and is carried onto the cylindrical surface 14 of the magnetic drum 12 in those portions where the cylindrical surface 14 has been magnetized. Generally only a very small amount of magnetic particles must be present in suspension in the ink to accomplish this result. Accordingly, the ink deposited need not be substantially darkened by the presence of the ferromagnetic particles.

In order to assure that an undesirable buildup of ferromagnetic particles does not occur on the surface 14 of the drum 12 it may be desirable to demagnetise the drum 12 whereby such particles can be readily removed. If the drum 12 is demagnetised before the cylindrical surface of the drum is contacted with a sheet which absorbs substantially all of the printing composition from the selectively coated portions on the surface 14 of the drum 12, than the ferromagnetic particles can be removed along with the ink. If it is not demagnetized the ferromagnetic particles can be left behind on the drum 12 while the ink prints off onto the paper. Thereafter, it may be desirable to demagnetise the cylindrical surface 14 to remove the ferromagnetic particles. Indeed, demagnetation is necessary, in any event, prior to again selectively magnetizing portions of the cylindrical surface 14 of the drum 12 to provide a successive image.

Any of a number of ferromagnetic particles may be utilized in the practice of the present invention. For example, the ferromagnetic particles can be particles of magnetite ($Fe_3O_4$). Finely, divided particles of pure ferromagnetic metals, perhaps coated to prevent oxidation, may also be utilized. Other useful ferromagnetic particles include alloys of iron, cobalt and/or nickel with each other and/or with other metals such as cesium, neodymium, lanthanum and/or praeseodynium. Other elements, for example, boron, can also be present. Somewhat higher coercivity can be obtained if the particles are $Nd_2Fe_{14}B$. The chemical makeup of the particles is of little or no importance so long as they have the required magnetic property and do not deleteriously affect the equipment or the final printed output.

The ferromagnetic particles may be of any resonable size, preferably no more than about 25 microns in largest dimension, usually between about 1 micron and about 15 microns and suitably from about 2 microns to about 10 microns.

The ferromagnetic particles must be in suspension in a liquid medium. Any of a number of liquid media, including non-aqueous media, may be utilized but it is anticipated that the invention will find its greatest use when the liquid medium is an aqueous medium since water will very readily transfer to paper and paper is the material upon which the printing is generally going to occur. Appropriate suspending agents can be present to hold the ferromagnetic particles in suspension. For example, any of the suspending agents normally utilized for this such purpose can be utilized in the practice of the present invention. Useful suspending agents include, for example, any of the binders currently used in the printing industry, e.g., rosin esters, metalled rosins, hydrocarbon resins, vinyl polymers, polyamides, and many others. Various common printing industry diluents, e.g., hydrocarbons, alcohols, aqueous based ammonia, and many other diluents, depending on the nature of the liquid medium, also can serve as suspending agents.

Any of a number of coloring agents can be utilized including virtually any desired dye having the requisite intensity which may be dissolved or suspended in the liquid medium, or any appropriate pigment which may be suspended in the liquid medium. Useful dyes include those currently used in the dyeing and printing industries, for example, dyes of the azo, triphenylmethane, anthroquinone, vat and phthalocyanine dye families. Exemplary dyes are diarylide yellow and phloxine.

Useful pigments include any of those currently used in the printing industry. Exemplary is titanium dioxide.

The dyes and pigments set forth above are merely illustrative and any desired dye or pigment can be utilized.

The liquid medium can also have other additives to control surface tension, viscosity, adhesion, heat resistance, or the like.

Mixtures of different pigments, of different dyes or of dyes and pigments, can also be utilized.

The relative amounts of the particles and of the coloring agent is controlled so that the color of the printing composition is substantially that of the coloring agent or mixture of coloring agents. Generally, as low an amount of ferromagnetic particles is used as is possible since the color desired is generally that of the coloring agent. And, the less ferromagnetic particles that are used, the more true will be the color of the printing composition to that of the coloring agent. In general, the weight ratio of total ferromagnetic particles to total coloring agent should be no greater than about 1:5, more preferably, no greater than about 1:10, still preferably no greater than about 1:50 and more preferably yet no more than about 1:100.

INDUSTRIAL APPLICABILITY

The present invention provides a printing composition, method and apparatus useful for providing color magnetographic printing.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

I claim:

1. A magnetographic printing method, comprising:

selectively magnetizing portions of the cylindrical surface of a drum to thereby provide an image thereon;

contacting the magnetized portions of the drum with a printing composition comprising a plurality of magnetic particles in suspension in a liquid medium having dissolved or suspended therein a coloring agent, the printing composition being on an anilox roller during the contacting, the relative amounts of the particles and the coloring agent being controlled whereby the color of the printing composition is substantially that of the coloring agent, whereby the magnetized portions of the drum are selectively coated by the printing composition; and contacting the cylindrical surface of the drum with a sheet which abstracts substantially all of the printing composition from the selectively coated portions of the cylindrical surface of the drum.

2. A method as set forth in claim 1, wherein the weight ratio of the particles to the total coloring agent is no more than about 1:10.

3. A method as set forth in claim 1, further including, intermediate said first and second contacting steps;

demagnetising the printing composition coated magnetized portions of the drum.

4. A method as set forth in claim 1, wherein said coloring agent is of a color different than that of said magnetic particle.

5. A method as set forth in claim 1, wherein said anilox roller does not contact said drum.

6. A magnetographic printing apparatus, comprising:

a drum having a cylindrical surface capable of being magnetized;

magnetizing means for magnetizing selected portions of said cylindrical surface;

printing composition contacting means comprising an anilox roller for contacting selectively magnetized portions of said cylindrical surface with a printing composition comprising a plurality of magnetic particles in suspension in a liquid medium having dissolved or suspended therein a coloring agent, the relative amount of particles and of the coloring agent being controlled whereby the color printing composition is substantially that of the coloring agent, to selectively coat said selectively magnetized portions; and means for contacting the cylindrical surface of the drum with a sheet which abstracts substantially all of the printing composition from the selectively coated portions thereof.

7. An apparatus as set forth in claim 6, wherein said liquid medium is an aqueous medium.

8. An apparatus as set forth in claim 7, further including:

means for demagnetising the magnetized portions of the drum.

9. An apparatus as set forth in claim 6, further including:

means for demagnetising the magnetized portions of the drum.

10. An apparatus as set forth in claim 6 wherein a weight ratio of particle to total coloring agent is no more than about 1:10.

11. An apparatus as set forth in claim 6, wherein said coloring agent is of a color different than that of said magnetic particles.

12. An apparatus as set forth in claim 6, wherein said anilox roller does not contact said drum.

* * * * *